US006923838B2

(12) United States Patent
Maubert et al.

(10) Patent No.: US 6,923,838 B2
(45) Date of Patent: Aug. 2, 2005

(54) FUEL ADDITIVE COMPOSITION AND METHOD FOR TREATMENT OF MIDDLE DISTILLATE FUELS AND GASOLINE

(75) Inventors: Paul H. Maubert, Frederick, MD (US); George W. Mushrush, Oakton, VA (US)

(73) Assignee: Advanced Combustion Technologies, Inc., Greenwich, CT (US)

( * ) Notice: Subject to any disclaimer, the term of this patent is extended or adjusted under 35 U.S.C. 154(b) by 500 days.

(21) Appl. No.: 10/442,968

(22) Filed: May 22, 2003

(65) Prior Publication Data

US 2003/0217505 A1 Nov. 27, 2003

Related U.S. Application Data

(60) Provisional application No. 60/382,450, filed on May 23, 2002.

(51) Int. Cl.[7] ..... C10L 1/18

(52) U.S. Cl. ..... 44/308; 44/388; 44/443; 44/447; 44/448; 44/450

(58) Field of Search ..... 44/308, 388, 443, 44/447, 448, 450

(56) References Cited

U.S. PATENT DOCUMENTS

| | | | | | |
|---|---|---|---|---|---|
| 4,364,743 | A | * | 12/1982 | Erner | 44/388 |
| 5,160,506 | A | * | 11/1992 | Schur et al. | 44/308 |
| 5,208,402 | A | * | 5/1993 | Wilson | 585/1 |
| 5,340,495 | A | * | 8/1994 | Mulcahy et al. | 134/32 |
| 5,578,090 | A | * | 11/1996 | Bradin | 44/308 |
| 5,607,486 | A | * | 3/1997 | Wilkins, Jr. | 44/307 |
| 5,705,087 | A | * | 1/1998 | Mushrush et al. | 252/70 |
| 6,172,031 | B1 | * | 1/2001 | Stevens | 510/417 |
| 6,183,525 | B1 | | 2/2001 | Jones | 44/443 |
| 6,419,715 | B1 | | 7/2002 | Jones et al. | 44/443 |

* cited by examiner

*Primary Examiner*—Cephia D. Toomer
(74) *Attorney, Agent, or Firm*—Antonelli, Terry, Stout & Kraus, LLP

(57) ABSTRACT

A fuel additive for middle distillate fuels is a mixture of at least one methyl, ethyl, propyl or butyl ester of a vegetable oil or a $C_{16}$–$C_{18}$ fatty acid, at least one alkyl ether of propylene glycol, a surfactant, and an antioxidant. A fuel additive for gasoline is a mixture of ligroin or toluene/xylene, at least one alkyl ether of propylene glycol, a surfactant, and tertiary amyl methyl ether.

17 Claims, No Drawings

FUEL ADDITIVE COMPOSITION AND METHOD FOR TREATMENT OF MIDDLE DISTILLATE FUELS AND GASOLINE

This application claims priority based on U.S. Provisional Application No. 60/382,450, filed May 23, 2002. The contents of the provisional application are incorporated herein by reference.

FIELD OF INVENTION

The present invention relates to a fuel additive composition and a method of treating fuels. More particularly, the present invention relates to a composition and method of treating fuels such as middle distillate fuels and gasoline to improve performance, increase lubricity, increase storage stability, increase combustion efficiency and decrease harmful emissions.

BACKGROUND OF THE INVENTION

Ongoing efforts have been made over the years to control the emissions created by the use of hydrocarbon fuels and to increase the performance of such fuels. One method that has been used is to increase the oxygen content of the fuels, for example by adding ethanol, as is done in the Midwest region of the United States, or by adding methyl tertiary butyl ether (MTBE), as is required in California and in major U.S. cities. However, MTBE is quite water soluble and the ground water in many parts of the United States is contaminated by MTBE. However, MTBE itself is a pollutant since it is very water-soluble and any fuel leak will pollute ground water with MTBE. Other proposed methods of increasing the oxygen content of fuels include adding ethers alone or adding ethers mixed with alcohols. Alcohols have the disadvantage that fuels that contain alcohols can become acidic from air oxidation of the alcohol and can form solids hat will plug filters and injectors if the fuel is stored for a long period of time. Further, alcohol compounds impart no lubricity to the fuel and can make the fuel more corrosive.

Peroxides have also been proposed as a source of oxygen for fuels, but peroxides are unstable and can cause the chemical breakdown of fuel in storage tanks, which makes the fuel unusable.

At the present time, there is a need for a product that has both a capability of effectively controlling harmful emissions in fuels such as middle distillate fuels and gasoline and a chemical compatibility with such fuels, so that the fuels remain stable for long periods of time under typical storage conditions.

SUMMARY OF THE INVENTION

Accordingly, it is an object of the present invention to provide a fuel additive package that overcomes all of the previous mentioned disadvantages.

It is another object of the present invention to provide increased lubricity for gasoline and middle distillate fuels or of synthetic fuels having the qualities of gasoline or middle distillate fuels to increase the operating lifetime of fuel handling components such as fuel pumps.

It is another object of the present invention to increase the storage lifetime of gasoline and middle distillate fuels, and of synthetic fuels having the qualities of gasoline or middle distillate fuels.

It is another object of the present invention to increase combustion efficiency and thus reduce harmful emissions of engines using gasoline, middle distillate fuels and synthetic fuels having the qualities of gasoline or middle distillate fuels.

It is another object of the present invention to provide an additive that can increase power and mileage of vehicles that use middle distillate fuels, gasoline or synthetic fuels having the qualities of gasoline or middle distillate fuels.

It is another object of the present invention to provide an additive that increases the thermal energy yield of middle distillate fuels used as heating oil.

These and other objects of the present invention are obtained by a fuel additive for middle distillate fuels comprising a mixture of (i) at least one alkyl ester of a vegetable oil or at least one methyl, ethyl, propyl or butyl ester of a $C_{16}$–$C_{18}$ fatty acid, (ii) at least one alkyl ether of propylene glycol, (iii) a surfactant, and (iv) an antioxidant. These and other objects of the present invention are obtained by a fuel additive for gasoline comprising a mixture of (i) at least one of ligroin or toluene, or xylene (ii) at least one alkyl ether of propylene glycol, (iii) a surfactant, and (iv) tertiary amyl methyl ether (TAME).

These mixtures accomplish an increase or improvement of performance, lubricity, storage stability, combustion efficiency, and a simultaneous decrease in emissions. The present invention has many advantages over prior art. The present invention uses environmentally safe (benign by design) materials. The use of vegetable oils such as soybean derived liquids, the use of polypropylene compounds which are much safer for both personnel and the environment compared to ethylene glycol materials. Also the current invention improves operating characteristics in addition to reducing harmful emissions.

DETAILED DESCRIPTION OF THE INVENTION

Composition for Middle Distillate Fuels

The term "middle distillate fuels" is used herein with the meaning as commonly understood in the art as the middle cut in a distillation of petroleum where gasoline is the top cut (having the lowest boiling point) and heavy fuel oils for boilers and electrical generation stations are at the bottom. Typically, middle distillate fuels consist of about 50 major components and several thousand minor constituents. The most common usage of middle distillate fuels is diesel ground transportation fuel, jet fuel, heating and electrical generation. The terms middle distillate fuel and diesel fuel (and the term diesel is to be understood to include Grades 1–6) may be used interchangeably herein without implying a limitation of either term. The term "middle distillate fuels" as used herein is also meant to apply to pure compounds or mixtures of a fewer compounds that are derived from middle distillate fuels or are synthesized de novo and have substantially the same properties and uses as middle distillate fuels derived from natural sources. The term "middle distillate fuels" as used herein also refers to home heating oil, which typically differs from diesel fuel only in that diesel fuel typically contains a dye so that it can be distinguished for tax purposes. The composition of the present invention does not affect the dye or its chemical stability. For convenience, the required dye could be added to the fuel additive composition of the present invention.

With respect to middle distillate fuels, the preferred additive composition according to the present invention is a mixture of (i) at least one methyl, ethyl, propyl or butyl ester of a vegetable oil or of a $C_{16}$–$C_{18}$ fatty acid, (ii) at least one alkyl ether of propylene glycol, (iii) a surfactant, and (iv) an antioxidant.

Without being limited to a particular theory, it is believed that the ester of a vegetable oil or of a $C_{16}$–$C_{18}$ fatty acid in the composition for middle distillate fuels of the present invention serves at least three functions in the present invention. First, it provides an internal source of oxygen to make combustion more complete and thus lower harmful emission products. Second, because of its ester chemical structure, it provides lubricity to the fuel. This provides the added benefit of increasing the lifetime of all fuel handling components such as pumps and injectors and drastically lowers vehicle maintenance costs. Third, because these esters are powerful solvents, they can help to keep the fuel system clean. Because the esters are stable at high temperatures, they can help to clean fuel system components such as fuel injectors, which typically become hot during the operation of an engine.

The ester component of the present composition may be obtained by esterifying any vegetable oil, including recycled cooking oil. The ester component may be esters of mixtures of different vegetable oils. Preferably, the vegetable oil is soybean oil, which typically has the composition set forth in Table 1:

TABLE 1

Distribution of Fatty Acids in Soybean Oil

| carbon number | fatty acid | concentration (wt %) |
|---|---|---|
| $C_{18}$ | linoleic | 53 |
| $C_{18}$ | oleic | 24 |
| $C_{18}$ | linoleic | 3 |
| $C_{18}$ | stearic | 10 |
| $C_{16}$ | palmitic | 10 |

Alternatively, the ester component of the present composition may be derived from any natural or artificial source of $C_{16}$–$C_{18}$ fatty acids. For example, a pure $C_{16}$ to $C_{18}$ fatty acid ester may be used, or mixtures of $C_{16}$–$C_{18}$ fatty acid esters.

The ester component is preferably a methyl ester, but may also be an ethyl, propyl or butyl ester. Methods of making methyl, ethyl, propyl or butyl esters of fatty acids are well known.

Preferably the ester component is contained in the fuel additive composition in the amount of 60–70% by weight of the fuel additive composition.

Without being limited to a particular theory, it is believed that the propylene glycol alkyl ether in the composition for middle distillate fuels of the present invention serves at least two functions. First, it provides an additional internal source of oxygen to make combustion more complete and thus lower harmful emission products. Second, it serves to disperse water that can form in fuel systems due to natural variations in temperature and humidity. In diesel vehicles fuel systems, water that infiltrates the system contributes to a large increase in maintenance costs. The dispersal of this water can serve to lower maintenance costs associated with the replacement of water separator filters in diesel fuel systems. A propylene glycol ether is preferred to other types of ethers such as ethylene glycol ether because it is non-toxic and requires no clean-up.

Preferably, the propylene glycol alkyl ether is propylene glycol butyl ether (a four carbon alkyl ether), but other ethers can be used. In particular, the propylene glycol alkyl ether can be, but is not limited to, any propylene glycol alkyl ethers with an alkyl moiety of 1 to 4 carbons (methyl, ethyl, propyl, or butyl).

Preferably the propylene glycol alkyl ether is contained in the fuel additive composition in the amount of 25–30% by weight.

Without being limited to a particular theory, it is believed that the surfactant in the composition middle distillate fuels of the present invention serves at least three functions including enhancing lubricity, helping to disperse water, and providing another internal source of oxygen to thereby reduce harmful emissions. The surfactant is selected as a compound capable of providing these functions. Preferably, the surfactant is a polyoxyethylene isooctylcyclohexyl ether or branched polyoxyethylene nonylcyclohexyl ether. Preferably the surfactant is contained in the fuel additive composition in the amount of 4–10%.

Without being limited to a particular theory, it is believed that the antioxidant in the composition middle distillate fuels of the present invention serves at least three functions including enhancing lubricity, providing another internal source of oxygen and reducing fuel degradation. The antioxidant is selected as a compound capable of providing these functions and is preferably a alkyl substituted phenol. In particular, the preferred antioxidant is a methyl, ethyl, propyl, or butyl-substituted phenol. Most preferably, the antioxidant is a 2- or 4-tert-butyl phenol.

Preferably the antioxidant is contained in the fuel additive composition in the amount of about 0.5 to 3.0% by weight.

A preferred composition for the additive for middle distillate fuels is set forth in Table 2 as follows:

TABLE 2

Preferred Composition for the Additive for Middle Distillate Fuels

| Additive Component | Concentration |
|---|---|
| Methyl ester of soybean oil | 60–70% by weight |
| Propylene glycol butyl ether | 25–30% by weight |
| polyoxyethylene isooctylcyclohexyl ether or branched polyoxyethylene nonylcyclohexyl ether | 4–10% by weight |
| 2- or 4-tert-butyl phenol | 0.5–3% by weight |

For winter operation, 1% by weight of glycerin ketals can be added for anti-icing.

The formulation described above is not sensitive as to the order of the constituents being added. The ingredients mix with ease and are not sensitive to normal environmental temperature or humidity conditions in which fuels are handled and used. The ester (component (i)) can be industrially made from food grade soy bean oil and thus represents no hazard in comparison to the diesel fuel itself. Thus, the additive formulation described above minimizes personnel and health exposures. In a middle distillate fuel, the components described above interact synergistically to provide a significant increase in performance and lower maintenance costs in diesel powered vehicles and in heating systems.

Another aspect of the present invention is a middle distillate fuel composition containing a middle distillate fuel and the above-described additive, wherein the additive is present in an amount of up to 0.1% by weight of the total composition.

Another aspect of the present invention is a method of treating a middle distillate fuel by adding the above-described additive to the middle distillate fuel in an amount of up to 0.1% by weight of the total composition. The method of treatment may, for example, reduce harmful emissions from combustion of the middle distillate fuel, increase performance and power and reduce engine wear of an engine using the middle distillate fuel containing the additive. If the middle distillate fuel is used in a heating system, the additive may provide increased performance, reduced emissions and lower maintenance costs. Further, a middle distillate fuel treated by the addition of the fuel additive as described above may show greater storage stability.

Composition for Gasoline

The term "gasoline" is used herein with the meaning as commonly understood in the art as a hydrocarbon fuel derived from a distillation fraction containing compounds ranging from about $C_4$ to $C_{10}$. Typically, gasoline consists of 40–50 major components and another 40 or so minor constituents. The term "gasoline" as used herein is also meant to apply to pure compounds or mixtures of fewer compounds that are derived from gasoline or are synthesized de novo and have substantially the same properties and uses as gasoline fuels derived from natural sources.

With respect to gasoline, the preferred additive composition is a mixture of (i) at least one of ligroin or toluene/xylene, (ii) at least one alkyl ether of propylene glycol, (iii) a surfactant, and (iv) tertiary amyl methyl ether (TAME).

Ligroin, also commonly referred to as petroleum ether, is a material that is available in several different temperature ranges and can be formulated by temperature for the region in which the gasoline is to be consumed. An example of a temperature range is 90°–110° C., but other temperature ranges may be used. Alternatively, toluene or xylene or a mixture of toluene and xylene may be used to increase the octane rating. Typically, toluene and xylene are already present in gasoline, and the increase in the concentration of these compounds can serve to increase the octane rating. Preferably, the ligroin or toluene/xylene is present in the additive composition in the amount of 50–70% by weight.

As in the composition for middle distillate fuels, without being limited to a particular theory, it is believed that the propylene glycol alkyl ether in the composition for gasoline of the present invention serves the functions of providing an additional internal source of oxygen to make combustion more complete and thus lowering harmful emission products and serving to disperse water that can form in fuel systems due to natural variations in temperature and humidity. Preferably, the propylene glycol alkyl ether is propylene glycol butyl ether (a four carbon alkyl ether), but other ethers can be used. In particular, the propylene glycol alkyl ether can be, but is not limited to, any propylene glycol alkyl ethers with an alkyl moiety of 1 to 4 carbons (methyl, ethyl, propyl, or butyl). Preferably the propylene glycol alkyl ether is contained in the fuel additive composition in the amount of 25–30% by weight.

As in the composition for middle distillate fuels, without being limited to a particular theory, it is believed that the surfactant in the composition for gasoline of the present invention serves at least three functions including enhancing lubricity, helping to disperse water, and providing another internal source of oxygen to thereby reduce harmful emissions. The surfactant is selected as a compound capable of providing these functions. Preferably, the surfactant is a polyoxyethylene isooctylcyclohexyl ether or branched polyoxyethylene nonylcyclohexyl ether. Preferably the surfactant is contained in the fuel additive composition in the amount of 4–9%.

The composition for gasoline of the present invention further contains tertiary amyl methyl ether (TAME) as an internal source of oxygen. Preferably, the TAME is contained in the fuel additive composition in the amount of 0.5–3%.

A preferred composition for the additive for middle distillate fuels is set forth in Table 3 as follows:

TABLE 3

Preferred Composition for the Additive for Middle Distillate Fuels

| Additive Component | Concentration |
|---|---|
| Ligroin (90°–110° C.) or toluene/xylene | 50–70% by weight |
| Propylene glycol butyl ether | 25–30% by weight |
| Polyolxyethylene isooctylcyclohexyl ether or branched polyoxyethylene nonylcyclohexyl ether | 4–19% by weight |
| Tertiary amyl methyl ether | 0.5–3% by weight |

The formulation described above is not sensitive as to the order of the constituents being added. The ingredients mix with ease and are not sensitive to normal environmental temperature or humidity conditions in which fuels are handled and used. Thus, the additive formulation described above minimizes personnel and health exposures.

In gasoline, the components described above interact synergistically to provide a dramatic increased performance in gasoline engines.

Another aspect of the present invention is a gasoline composition containing gasoline and the above-described additive, wherein the additive is present in an amount of up to 0.1% by weight of the total composition.

Another aspect of the present invention is a method of gasoline by adding the above-described additive to the gasoline in an amount of up to 0.1% by weight of the total composition. The method of treatment may, for example, reduce harmful emissions from combustion of the gasoline, increase performance and power and reduce engine wear of an engine using gasoline containing the additive. Further, gasoline treated by the addition of the fuel additive as described above may show greater storage stability.

EXAMPLES

Having described the invention, the following examples are given to illustrate specific applications of the invention, including the best mode now known to perform the invention. These specific examples are not intended to limit the scope of the invention described in this application.

Example 1

A fuel additive composition for middle distillate fuels is made by blending the following ingredients:

| | |
|---|---|
| Methyl ester of soybean oil | 60% by weight |
| Propylene glycol butyl ether | 30% by weight |
| Polyoxyethylene isooctylcyclohexyl ether or branched polyoxyethylene nonylcyclohexyl ether | 9% by weight |
| 2- or 4-tert-Butyl phenol | 1% by weight |

The fuel additive composition is added to a middle distillate fuel in the amount of up to 0.1% by weight.

Example 2

A fuel additive composition for gasoline is made by blending the following ingredients:

| | |
|---|---|
| Logroin (90°–110° C.) | 60% by weight |
| Propylene glycol butyl ether | 30% by weight |
| Polyoxyethylene isooctylcyclohexyl ether or branched polyoxyethylene nonylcyclohexyl ether | 9% by weight |
| Tertiary amyl methyl ether | 1% by weight |

The fuel additive composition is added to a middle distillate fuel in the amount of up to 0.1% by weight.

Obviously, many modifications and variations of the present invention are possible in light of the above teachings. It is therefore to be understood that, within the scope of the appended claims, the invention may be practiced otherwise than as specifically described.

We claim:

1. A fuel additive for use in middle distillate fuels, the additive comprising:

at least one methyl, ethyl, propyl or butyl ester of at least one vegetable oil or of at least one $C_{16}$–$C_{18}$ fatty acid, at least one alkyl ether of propylene glycol, a surfactant, and an antioxidant.

2. The fuel additive of claim 1 wherein the vegetable oil is soybean oil.

3. The fuel additive of claim 1 wherein the alkyl ether of propylene glycol is propylene glycol butyl ether.

4. The fuel additive of claim 1 wherein the surfactant is polyoxyethylene isooctylcyclohexyl ether or branched polyoxyethylene nonylcyclohexyl ether.

5. The fuel additive of claim 1 wherein the antioxidant is a 2- or 4-tert-butyl phenol.

6. The fuel additive of claim 1, wherein the fuel additive comprises:

methyl ester of soybean oil in the amount of 60–70% by weight;

propylene glycol butyl ether in the amount of 25–30% by weight;

as the surfactant, polyoxyethylene isooctylcyclohexyl ether or branched polyoxyethylene nonylcyclohexyl ether in the amount of 4–10% by weight; and as the antioxidant, 2- or 4-tert-butyl phenol in the amount of 0.5–3% by weight.

7. A composition comprising (i) a middle distillate fuel and (ii) the fuel additive of claim 1, wherein the fuel additive is present in an amount of up to 0.1% by weight of the total composition.

8. A composition comprising (i) a middle distillate fuel and (ii) the fuel additive of claim 6, wherein the fuel additive is present in an amount of up to 0.1% by weight of the total composition.

9. A method of treating a middle distillate fuel, the method comprising the steps of providing a fuel additive comprising at least one methyl, ethyl, propyl or butyl ester of at least one vegetable oil or of at least one $C_{16}$–$C_{18}$ fatty acid, at least one alkyl ether of propylene glycol, a surfactant, and an antioxidant, and adding said additive to the middle distillate fuel in an amount of up to 0.1% by weight of the total composition.

10. The method of claim 9 wherein the fuel additive comprises:

methyl ester of soybean oil in the amount of 60–70% by weight;

propylene glycol butyl ether in the amount of 25–30% by weight;

as the surfactant, polyoxyethylene isooctylcyclohexyl ether or branched polyoxyethylene nonylcyclohexyl ether in the amount of 4–10% by weight; and as the antioxidant, 2- or 4-tert-butyl phenol in the amount of 0.5–3% by weight.

11. A fuel additive for use in gasoline type fuels, the additive comprising:

at least one of ligroin or toluene/xylene, at least one alkyl ether of propylene glycol, a surfactant, and tertiary amyl methyl ether.

12. The fuel additive of claim 11 wherein the alkyl ether of propylene glycol is propylene glycol butyl ether.

13. The fuel additive of claim 11 wherein the surfactant is polyoxyethylene isooctylcyclohexyl ether or branched polyoxyethylene nonylcyclohexyl ether.

14. The fuel additive of claim 11, wherein the fuel additive comprises:

ligroin (90°–110° C.) or toluene/xylene in the amount of 50–70% by weight;

propylene glycol butyl ether in the amount of 25–30% by weight;

polyoxyethylene isooctylcyclohexyl ether or branched polyoxyethylene nonylcyclohexyl ether in the amount of 4–19% by weight; and tertiary amyl methyl ether in the amount of 0.5–3% by weight.

15. A composition comprising (i) gasoline and (ii) a fuel additive, wherein the fuel additive comprises the fuel additive of claim 11, and the fuel additive is present in an amount of up to 0.1% by weight of the total composition.

16. A method of treating gasoline, the method comprising the steps of providing a fuel additive comprising at least one of ligroin or toluene/xylene, at least one alkyl ether of propylene glycol, a surfactant, and tertiary amyl methyl ether, and adding said additive to the gasoline in an amount of up to 0.1% by weight of the total composition.

17. The method of claim 16 wherein the fuel additive comprises:

ligroin (90°–110° C.) or toluene/xylene in the amount of 50–70% by weight;

propylene glycol butyl ether in the amount of 25–30% by weight;

polyoxyethylene isooctylcyclohexyl ether or branched polyoxyethylene nonylcyclohexyl ether in the amount of 4–19% by weight; and tertiary amyl methyl ether in the amount of 0.5–3% by weight.

* * * * *